United States Patent [19]

Robinson

[11] 4,365,814

[45] Dec. 28, 1982

[54] BATTING GAME

[76] Inventor: Roy M. Robinson, Rte. 7, P. Box 457, Lexington, N.C. 27292

[21] Appl. No.: 257,941

[22] Filed: Apr. 27, 1981

[51] Int. Cl.[3] ..... A63B 67/00

[52] U.S. Cl. ..... 273/317; 124/16; 273/341

[58] Field of Search ..... 273/317, 341, 324, 337; 124/21, 26, 16; 46/145

[56] References Cited

U.S. PATENT DOCUMENTS

| | | | |
|---|---|---|---|
| 3,108,395 | 10/1963 | Goldfarb | 124/26 X |
| 3,232,618 | 2/1966 | Anderson | 273/341 |
| 3,581,434 | 6/1971 | Fels | 46/145 |
| 3,817,525 | 6/1974 | Henry | 273/341 |
| 4,052,065 | 10/1977 | Rodriquez | 273/341 |
| 4,093,226 | 6/1978 | Priestle | 273/341 |
| 4,149,724 | 4/1979 | Walsh | 273/341 |
| 4,183,532 | 1/1980 | Iglesias et al. | 273/341 |

FOREIGN PATENT DOCUMENTS

| | | | |
|---|---|---|---|
| 375413 | 6/1932 | United Kingdom | 273/341 |

*Primary Examiner*—William H. Grieb
*Attorney, Agent, or Firm*—James J. Brown

[57] ABSTRACT

A batting game is described which comprises a spring loaded, vertical tube mounted on a base and adapted to receive an elongated projectile in the open end of the tube. The projectile is supported by a compressible spring in the tube. A batter strikes the end of the projectile downward, thereby driving it into the tube and compressing the spring. Relaxation of the spring ejects the projectile vertically into the air where it is struck a second time by the batter and driven in a lateral direction.

6 Claims, 3 Drawing Figures

BATTING GAME

BACKGROUND OF THE INVENTION

This invention relates to a game device for propelling a projectile into the air so that it can be struck by a bat and driven a distance. The device is particularly suitable for use in a game that can be played by one or more people or as an exercise device.

Various devices are known in the art for propelling objects such as sticks into the air so that they can then be struck by a bat or similar deivce. Typical and perhaps simplest of these are the games commonly known as "tip-cat" in which an elongated projectile is rested in an inclined or horizontal position so that when it is struck with a bat or stick on one end it "flips" up into the air where it can be struck a second time. Devices of this type are disclosed, for example, in U.S. Pat. No. 4,183,532 to Iglesias et al; U.S. Pat. No. 4,149,724 to Walsh; U.S. Pat. No. 4,093,226 to Priestle; U.S. Pat. No. 3,817,525 to Henry and U.S. Pat. No. 3,232,618 to Anderson, Sr. While such devices are relatively simple, the pat of the spinning projectile is essentially unpredictable and may even hit the "batter".

U.S. Pat. No. 4,052,065 to Rodriguez describes a device in which a short, cylindrical projectile with an inclined face on one end is nested horizontally atop a spring loaded plunger. When the projectile is struck downward with a bat, the plunger compresses the spring, which, on release, propells the projectile upward. The device produces an erratic, unpredictable flight for the projectile and is relatively complex in structure.

It is an object of the present invention to provide a game device for propelling upward a projectile into the air where it can be batted, which is relatively simple and inexpensive to build and which produces a predictable and safe path of flight for the upward propelled projectile.

SUMMARY OF THE INVENTION

The present invention is a game device which essentially consists of an elongated, hollow tube mounted upright on a supportive base. The tube, which may be several concentric cylinders or a single cylindrical member, is open at its upper end and contains a compressible spring which supports a projectile that is inserted into the open end of the tube. The upper portion of the projectile extends beyond the mouth of the tube and, in accordance with the invention, is struck in a downward direction by a bat or similar device to depress the projectile into the tube and against the supportive spring which is compressed by the downward movement of the projectile. The expansive force of the compressed spring then propells the projectile out of the tube in an upward, generally vertical direction where it can be struck a second time with the bat to propel it laterally in a desired direction.

The projectile itself will normally be of approximately the same cross-section as the interior of the upright tube, but should not fit so snugly into the tube that flight of the projectile from the tube is impaired.

Further advantages and features of the present invention will become apparent from the following description of the accompanying drawings.

DETAILED DESCRIPTION OF AN EMBODIMENT OF THE INVENTION

Figure 1:
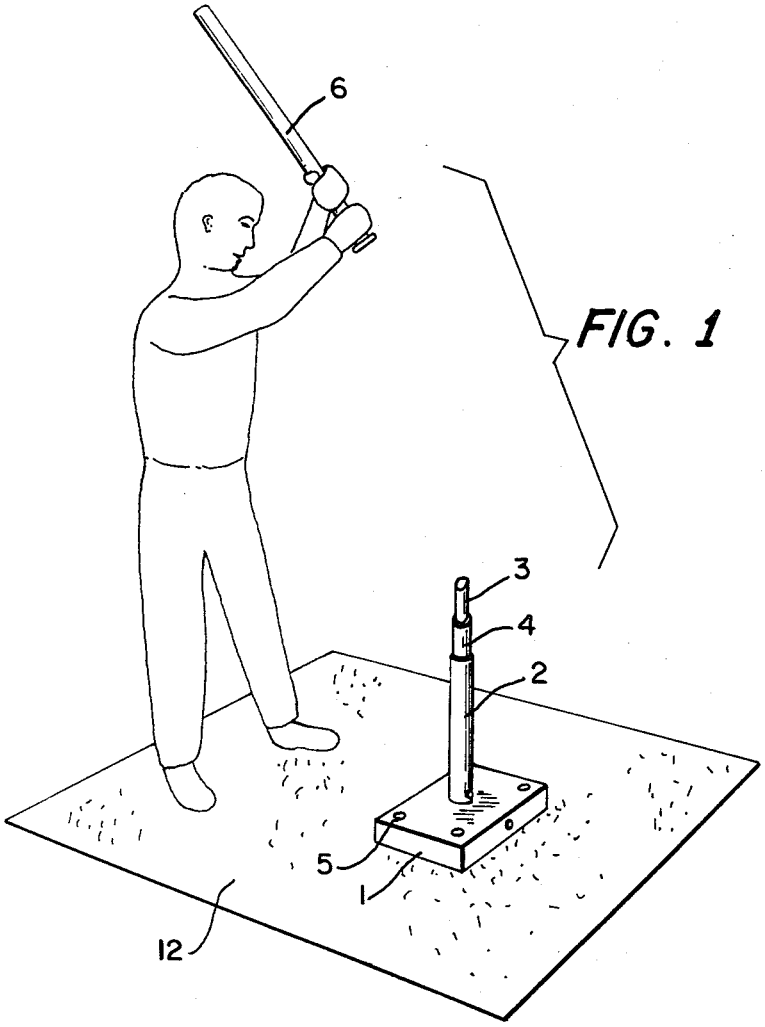
FIG. 1 is an overall perspective view showing the device of the invention, on the ground with a player holding a bat standing in playing position.

Directing attention to FIG. 1, the device of the present invention is shown resting on a surface 12 which may be synthetic turf or other synthetic material or grass or the ground. The device of the invention comprises a generally flat base member 1 with a plurality of downwardly disposed spikes or other means for firmly attaching it to the ground surface. The lower end of an upright tube comprising cylinders 2 and 4 is disposed in a recess in the base member 1. The cylinder 2 has disposed in its upper end concentrically a smaller also upright cylinder 4. Within the smaller cylinder 4 is removably disposed the pointer stick 3 which is propelled from the device into the air. The pointer stick 3 is propelled from the device by first striking it downwardly with a bat 6 which causes the pointer to be depressed into the cylinder 4 and then to spring up out of the cylinder where it is struck a second time by the player holding the bat 6.

Figure 2:
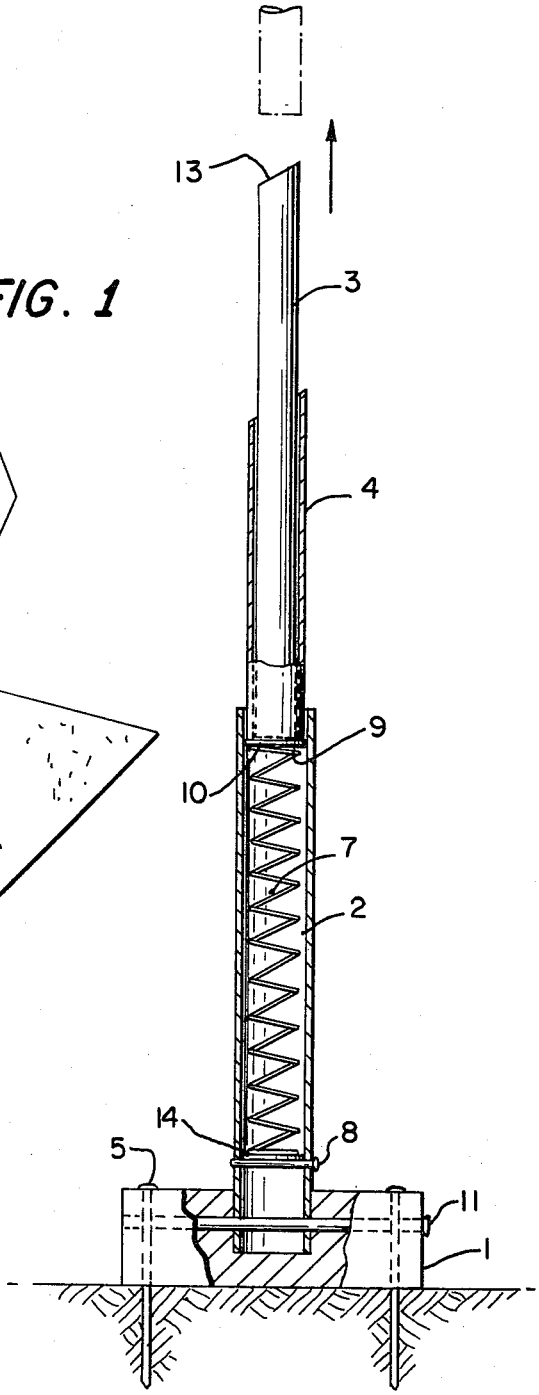
FIG. 2 is a cut-away side view of the device.
Figure 3:
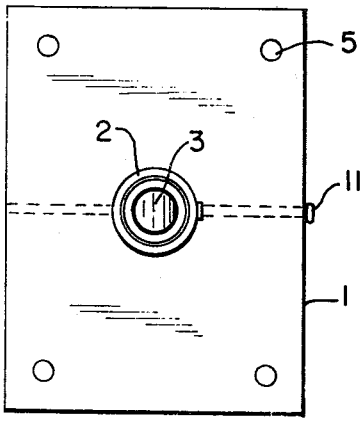
FIG. 3 is a top view of the device.

Directing attention to FIGS. 2 and 3 of the drawings, it will be seen that the base 1 contains a recessed portion into which the lower end of the vertically disposed tube comprising cylinders 2 and 4 is inserted. A horizontal pin member 11, which may completely pass through the base 1, also passes through the lower end of the cylinder 2 thereby firmly attaching it to the base 1. Within the cylinder 2 is disposed a compressible spring member 7 which rests on a washer means or plate 14 which itself is held in position in the lower end of the cylinder 2 by a pin 8. The upper end of the compressible spring 7 supports a similar plate or washer at a position below the top of the cylinder 2. A second smaller cylinder 4 is vertically disposed in the upper end of the cylinder 2 with its lower end being inserted a short distance into the larger cylinder and attached at that point, for example, by means of adhesive. The lower end of the smaller cylinder 4 disposed within the larger cylinder 2 also serves as a stop to prevent the spring 7 and washer 10 from pushing out of the top of the cylinder 2. The pointer stick 3 is flat on its lower end but has a slanted or pointed configuration 13 on its upper end in order to deflect the downward blow of the bat 6. The pointer stick is of essentially the same outside diameter and cross section as the inside diameter and cross section of the cylinder 4 into which it is inserted. When in place within the cylinder 4, the pointer stick rests upon the washer 10 which is supported by the upper end 9 of the spring 7. The top end of the cylinder 4 is generally cut off at an angle corresponding to the angle of the point 13 on the pointer stick. A plurality of spikes or other devices 5 pass vertically downward through the base member 1 into the ground for other material to hold the device in place.

When placed in the cylinder 4, the pointer stick 3 has approximately one half of its length within the cylinder 4 with the other half extending outward. When the end 13 of the pointer stick 3 is struck in a downward direction with a bat or stick 6 it presses downward against the washer 10 thereby compressing the spring 7 in the cylinder 2 against the lower washer 14 supported by the pin 8. Reflex expansion of the spring 7 then causes the pointer stick 3 to be propelled upward through the cylinder 4 in a generally vertical direction where it is struck a second time by the bat or stick 6 thereby propelling it in a generally horizontal direction for a considerable distance. Because of the pointer stick being disposed within the barrel-like vertical tube and propelled out of this tube, its general upward direction is relatively straight, predictable and not inclined to be of danger to the batsman waiting to strike it a second time.

It will be appreciated that the device of the present invention may be constructed of various inexpensive and readily available materials. The base member, for example, may be of wood or similar material and the vertically disposed tubes can be conventional metal or plastic tubing as long as they possess sufficient rigidity. Similarly, the pointer may be of solid wood construction or of other similar material.

It will further be appreciated by those of ordinary skill in the art, that various modifications may be made in the present invention as described herein without departing of the scope of the present invention.

I claim:

1. A game device comprising:

1. a base;
2. an elongated open-ended hollow tube disposed upright on said base and comprising a first cylinder of larger diameter mounted vertically on said base and a second smaller cylinder of essentially the same outside cross section as the inside cross section of said larger cylinder, said smaller cylinder having one end attached within the upper, open end of said larger cylinder.
3. an elongated projectile adapted to fit in the open end of said tube and be ejected therefrom;
4. means for ejecting said projectile from said tube in response to downward pressure on the projectile in the tube, said means being disposed in said tube and adapted to engage said projectile when placed in the tube.

2. The device of claim 1, wherein said ejection means is disposed within said larger cylinder.

3. The device of claim 1, wherein said means for ejecting the projectile is a compressible spring disposed in said tube.

4. The device of claim 1, wherein said base is provided with means for attaching it to a ground surface.

5. The device of claim 1, wherein one end of said projectile is pointed or angled to deflect a blow delivered thereto.

6. The device of claim 1, wherein said projectile is adapted to fit into said smaller cylinder in engagement with said ejection means.

* * * * *